US012454829B2

(12) United States Patent
Naylor et al.

(10) Patent No.: US 12,454,829 B2
(45) Date of Patent: Oct. 28, 2025

(54) SUNSHADE ATTACHMENT SYSTEM

(71) Applicant: Bok Modern LLC, San Rafael, CA (US)

(72) Inventors: Russell Naylor, San Francisco, CA (US); Alan Beirne, San Francisco, CA (US); Cameron Egan, Richmond, CA (US)

(73) Assignee: BK Modern LLC, San Rafael, CA (US)

( * ) Notice: Subject to any disclaimer, the term of this patent is extended or adjusted under 35 U.S.C. 154(b) by 47 days.

(21) Appl. No.: 17/887,363

(22) Filed: Aug. 12, 2022

(65) Prior Publication Data

US 2023/0051964 A1 Feb. 16, 2023

Related U.S. Application Data

(60) Provisional application No. 63/232,600, filed on Aug. 12, 2021.

(51) Int. Cl.
*E04F 10/00* (2006.01)

(52) U.S. Cl.
CPC ..... *E04F 10/005* (2013.01)

(58) Field of Classification Search
CPC ..... E04F 10/00; E04F 10/005
See application file for complete search history.

(56) References Cited

U.S. PATENT DOCUMENTS 3,129,793 A 4/1964 Ferrell
3,299,570 A * 1/1967 Radcliffe ..... E04F 10/00 49/27
3,743,346 A * 7/1973 Senn ..... B60P 3/34 296/26.15
3,911,633 A * 10/1975 Bamberger ..... E04F 10/08 52/75
4,454,691 A * 6/1984 Mitchell ..... E06B 9/0669 160/117
4,555,867 A * 12/1985 Stibolt ..... E06B 9/04 49/504
4,663,885 A * 5/1987 Stibolt ..... E06B 9/04 49/504
5,109,641 A * 5/1992 Halan ..... E04D 13/1478 52/62
5,228,238 A * 7/1993 Fenkell ..... E06B 3/38 49/63
5,537,779 A * 7/1996 Jackson ..... E06B 9/02 49/463

(Continued)

*Primary Examiner* — Chi Q Nguyen
(74) *Attorney, Agent, or Firm* — Patrick Sheldrake

(57) ABSTRACT

A sunshade attachment system for attaching shade panels around the perimeter of a window includes one or more cleats each having a building attachment flange for attachment to the face of the building around the window and a sunshade attachment flange extending perpendicularly from the building attachment flange. A sunshade panel is attached to the sunshade attachment flange of the cleat. A tapered end panel of the sunshade panel is attached to an end support extending perpendicularly from one end of the sunshade attachment flange. A nailing tab extends perpendicularly from the end support for nailing to the face of the building. The ends of two adjacent sunshade panels are connected using a hook and slot system.

20 Claims, 7 Drawing Sheets

(56) References Cited

U.S. PATENT DOCUMENTS 5,572,840 A * 11/1996 Fast ..... E06B 1/6015 49/504
5,737,874 A * 4/1998 Sipos ..... E06B 9/02 49/63
5,797,223 A * 8/1998 Shoup ..... E06B 9/52 52/656.9
5,832,666 A * 11/1998 Flack ..... E06B 9/04 49/67
5,907,929 A * 6/1999 Poma ..... E06B 7/082 52/203
5,921,056 A * 7/1999 Weiss ..... E06B 1/62 52/212
6,044,611 A * 4/2000 Brunett ..... E06B 1/62 52/717.03
6,167,897 B1 * 1/2001 Resso ..... E04F 10/005 135/121
6,401,402 B1 * 6/2002 Williams ..... E06B 1/70 52/287.1
6,843,023 B2 * 1/2005 Liu ..... E06B 3/5018 49/143
7,165,596 B1 * 1/2007 Helton ..... E06B 7/26 454/220
7,676,996 B2 * 3/2010 Teodorovich ..... E06B 1/62 52/60
7,905,241 B2 * 3/2011 DeVries ..... H01Q 1/1242 135/900
7,967,050 B2 * 6/2011 Gutierrez ..... E04F 10/0603 160/67
7,984,695 B1 * 7/2011 Shaffer ..... E06B 7/32 119/501
8,082,697 B2 * 12/2011 Griffiths ..... E04F 10/005 248/273
8,365,458 B2 * 2/2013 Omura ..... A01K 87/04 43/24
8,561,357 B2 * 10/2013 Teodorovich ..... E06B 1/62 52/302.6
9,187,922 B1 * 11/2015 Phillips, Jr. ..... E04H 15/58
9,932,768 B2 4/2018 Valinejadshoubi et al.
10,081,972 B1 * 9/2018 Kunz ..... E05D 5/02
10,900,272 B2 * 1/2021 Glickman ..... E06B 1/62
2003/0056450 A1 * 3/2003 Bealko ..... E06B 1/702 52/204.55
2004/0058638 A1 * 3/2004 Achen ..... F24F 13/082 454/280
2005/0022944 A1 * 2/2005 Humble ..... E04F 10/005 160/59
2005/0034388 A1 * 2/2005 Bealko ..... E06B 1/62 52/204.5
2016/0312461 A1 10/2016 Naylor et al.

* cited by examiner

SUNSHADE ATTACHMENT SYSTEM

CROSS-REFERENCE TO RELATED APPLICATION

This application claims the benefit of U.S. Provisional Application No. 63/232,600, filed Aug. 12, 2021, which is incorporated herein fully by reference.

BACKGROUND

Technical Field

The present invention relates generally to building construction and more particularly to sun shading panels that extending outwardly from the face of a building generally around the perimeters of windows.

Description of Related Art

Sunshade panels are used to shade windows from the sun while retaining most of the view through the window from inside a building. The conventional way to install sunshades is to attach the sunshades around the window during construction of the building. Unfortunately, this usually occurs when scaffolding remains erected around the structure with the result that the relatively delicate sunshade panels can become damaged as construction progresses.

There is, therefore, a need for a system and method for attaching sunshade panels around the perimeter of a window toward the end of construction of a building when scaffolding and other construction equipment is least likely to contribute to damaging the sunshade panels.

SUMMARY OF THE INVENTION

A sunshade attachment system for securing one or ore sunshades around the perimeter of window comprises one or more cleats each having a building attachment flange for securing the cleat to the face of a budding around the window, a sunshade attachment flange extending perpendicularly from the budding attachment flange, and one or more sunshade panels each secured to the sunshade attachment flange of one of the cleats so that when the building attachment flange of the cleat is attached to the face of the budding the sunshade panel extends perpendicularly from the face of the budding. The sunshade attachment system allows sunshades to be attached to the building later in the construction process to avoid damage from scaffolding and other heavy equipment.

DETAILED DESCRIPTION OF THE ILLUSTRATED EMBODIMENT

Figure 1:
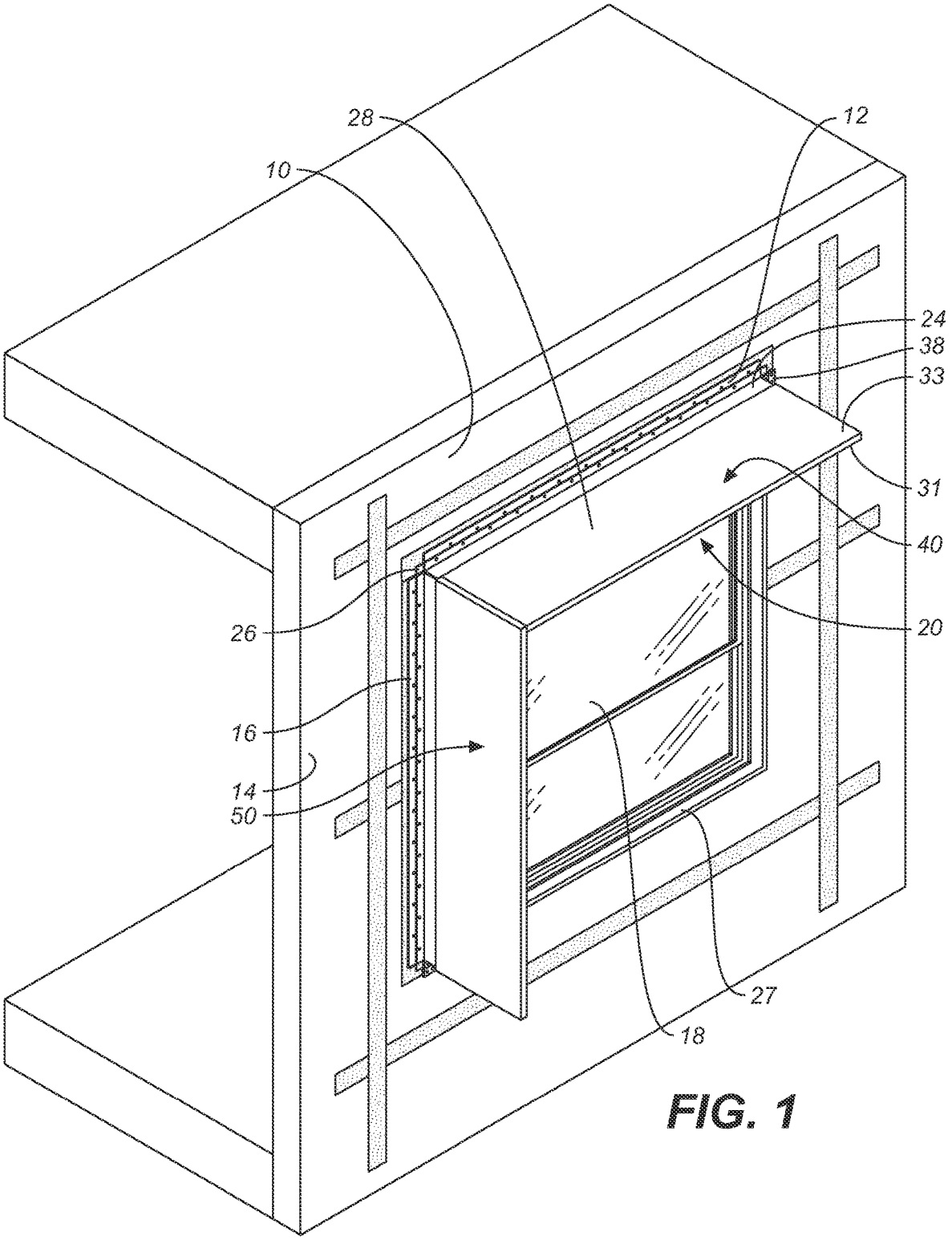
FIG. 1 is an upper perspective view of a sunshade attachment system according to the invention.

A sunshade attachment system according to the invention, referred to generally at 10 in FIG. 1, comprises one or more cleats 12 for attachment to the face 14 of a wall around the nailing flange 16 of an installed window 18. Attachment to a wooden structure is generally accomplished using nails, but threaded fasteners can also be used. Attachment to a metallic underlayment is usually performed using threaded fasteners. After the exterior finish has been installed over the moisture barrier, a sunshade panel, referenced generally at 20, is attached to each cleat 12.

Figure 2:
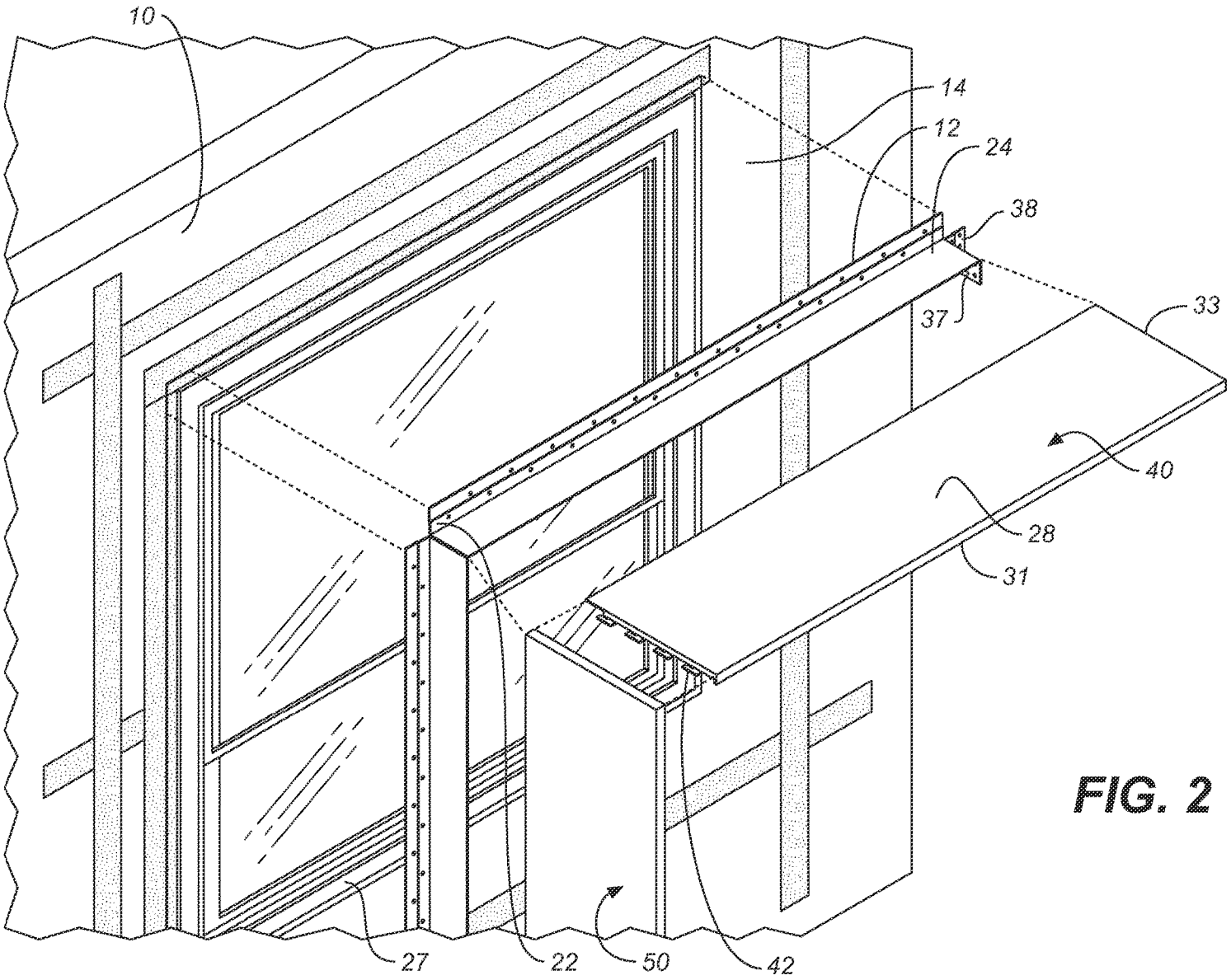
FIG. 2 is an exploded upper perspective view of the sunshade attachment system shown in FIG. 1.
Figure 3:
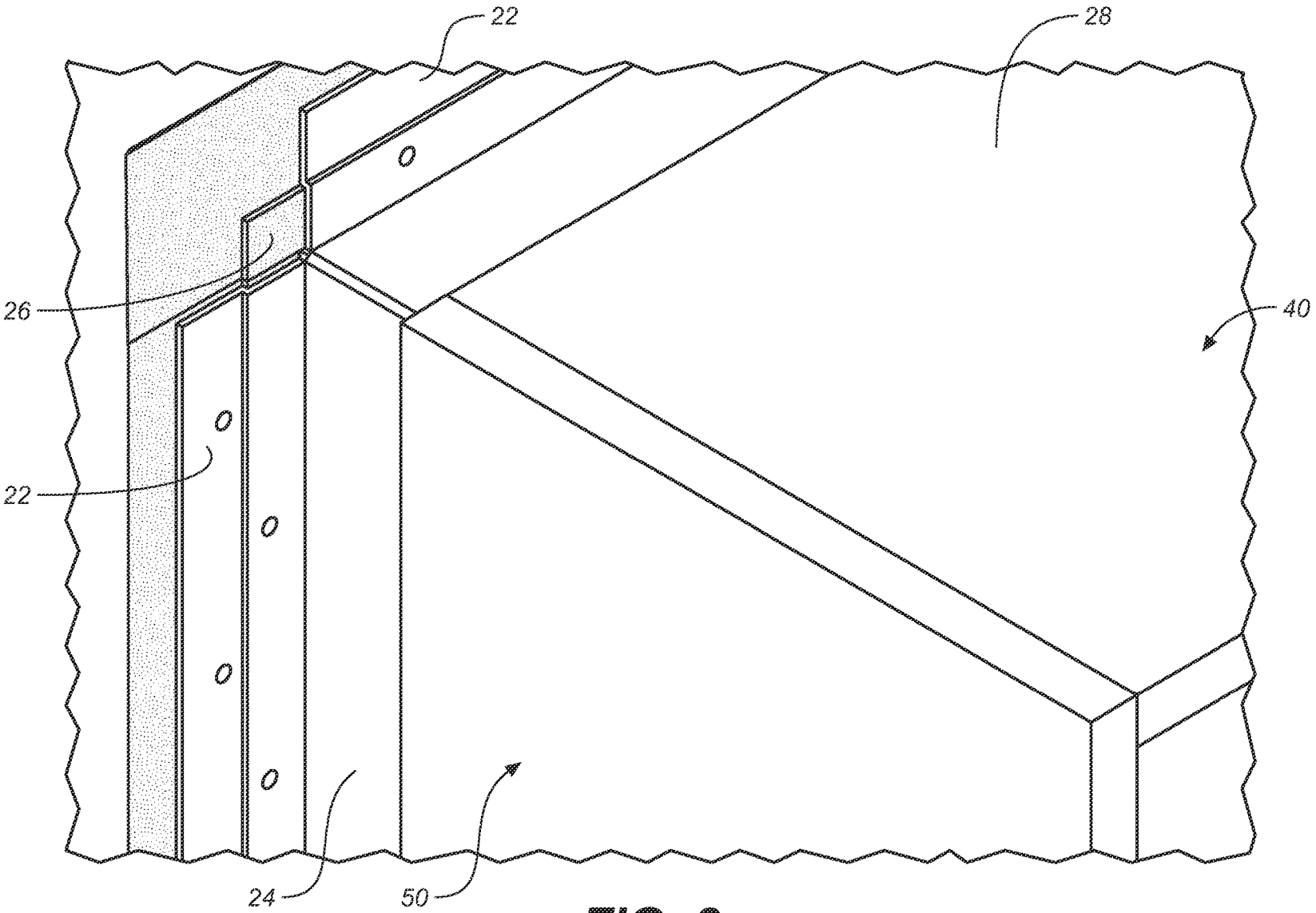
FIG. 3 is a close-up upper left perspective view of one corner of a window showing cleats and sunshade panels installed.
Figure 4:
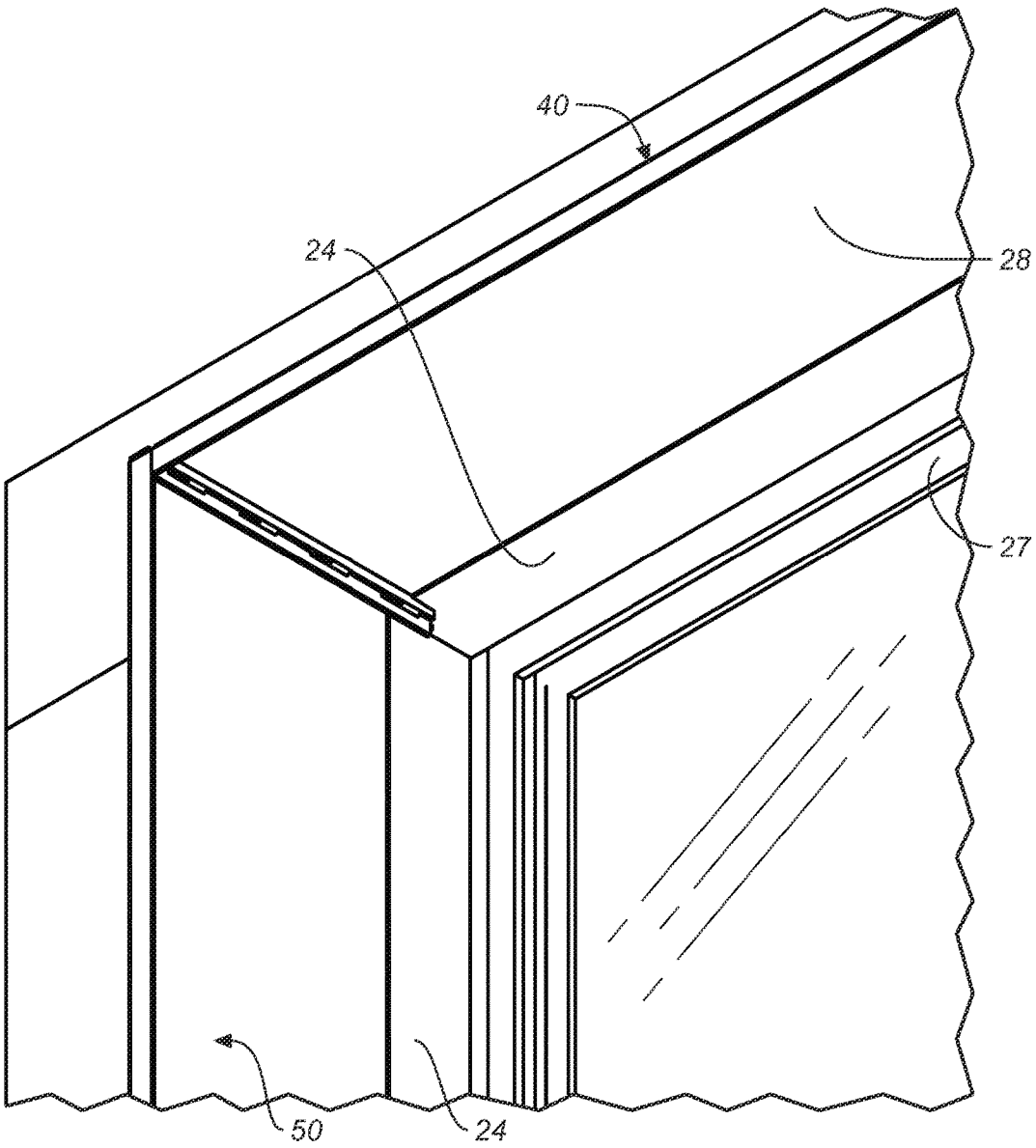
FIG. 4 is a lower right perspective view of a corner where two sunshade panels are attached around the frame of a window.

With reference to FIG. 2, each cleat 12 includes a building attachment flange 22 for securing the cleat to the face 14 of the wall, and a sunshade attachment flange 24 extending perpendicularly from the building attachment flange 22 and away from the face 14 of the wall for attaching a sunshade around the perimeter of the window. With additional reference to FIGS. 3 and 4 it can be seen that the building attachment flange 22 of the cleat 12 is attached over the window's nailing flange 26 so that the sunshade attachment flange 24 abuts the window frame 27. One or more cleats 12 can be attached around the window depending on how much shading is desired. After the desired number of cleats are installed, waterproofing tape or flashing can be installed over the building attachment flanges 22 of the cleats 12 and the nailing flanges 26 of the window to create a water-tight barrier surrounding the window such that the sunshade panels 40, 50, once installed, do not impact the water proofing barrier.

Once the cleat or cleats are secured in place, a sunshade panel 20 is attached to each cleat 12 as seen in FIG. 1 so that the sunshade panel is supported perpendicularly from the face 14 of the building.

Figure 5:
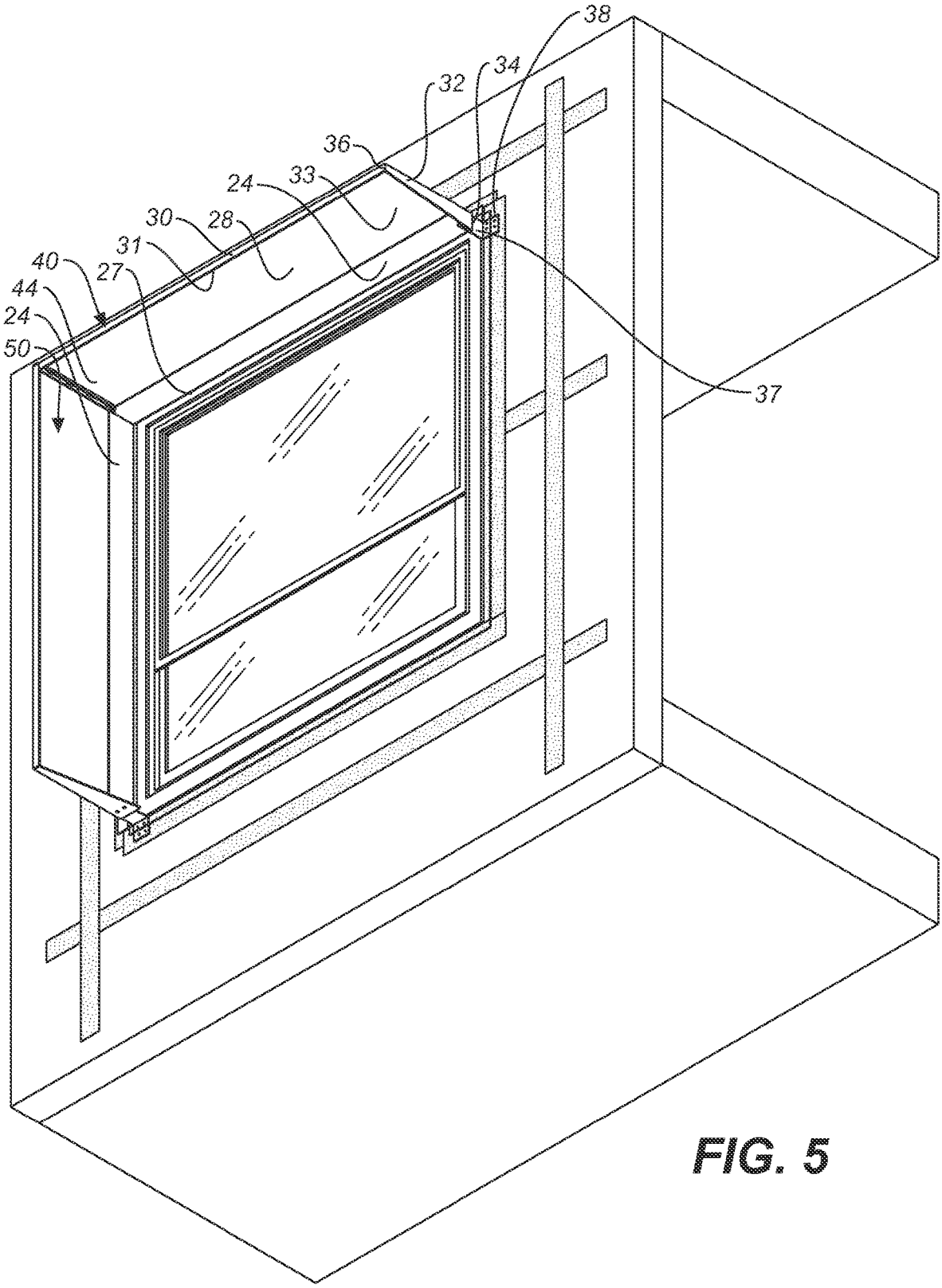
FIG. 5 is a lower right perspective view of two adjoining sunshade panels attached around a window using cleats according to the invention.

In one embodiment shown in FIG. 5, the sunshade panel 20 includes a main panel 28, a front panel 30 angled from a front edge 31 of the main panel 28 toward the window, and an end panel 32 on a first end 33 of the main panel 28 that extends perpendicularly from one side thereof. The end panel 32 has a proximal edge 34, generally disposed adjacent the building face, and a distal edge 36 narrower than the proximal edge which gives the end panel 30 and the overall sunshade panel 20 a tapered appearance.

With continuing reference to FIG. 5, an end support 37 extends perpendicularly from the sunshade attachment flange 24 of cleat 12 to which the proximal edge 34 of the end panel 30 of the sunshade panel can be attached. A nailing tab 38 extends perpendicularly from one side of the end support 37 for securing the end support 37 to the face of the building and strengthening the support given to the sunshade's end panel 32.

Figure 6:
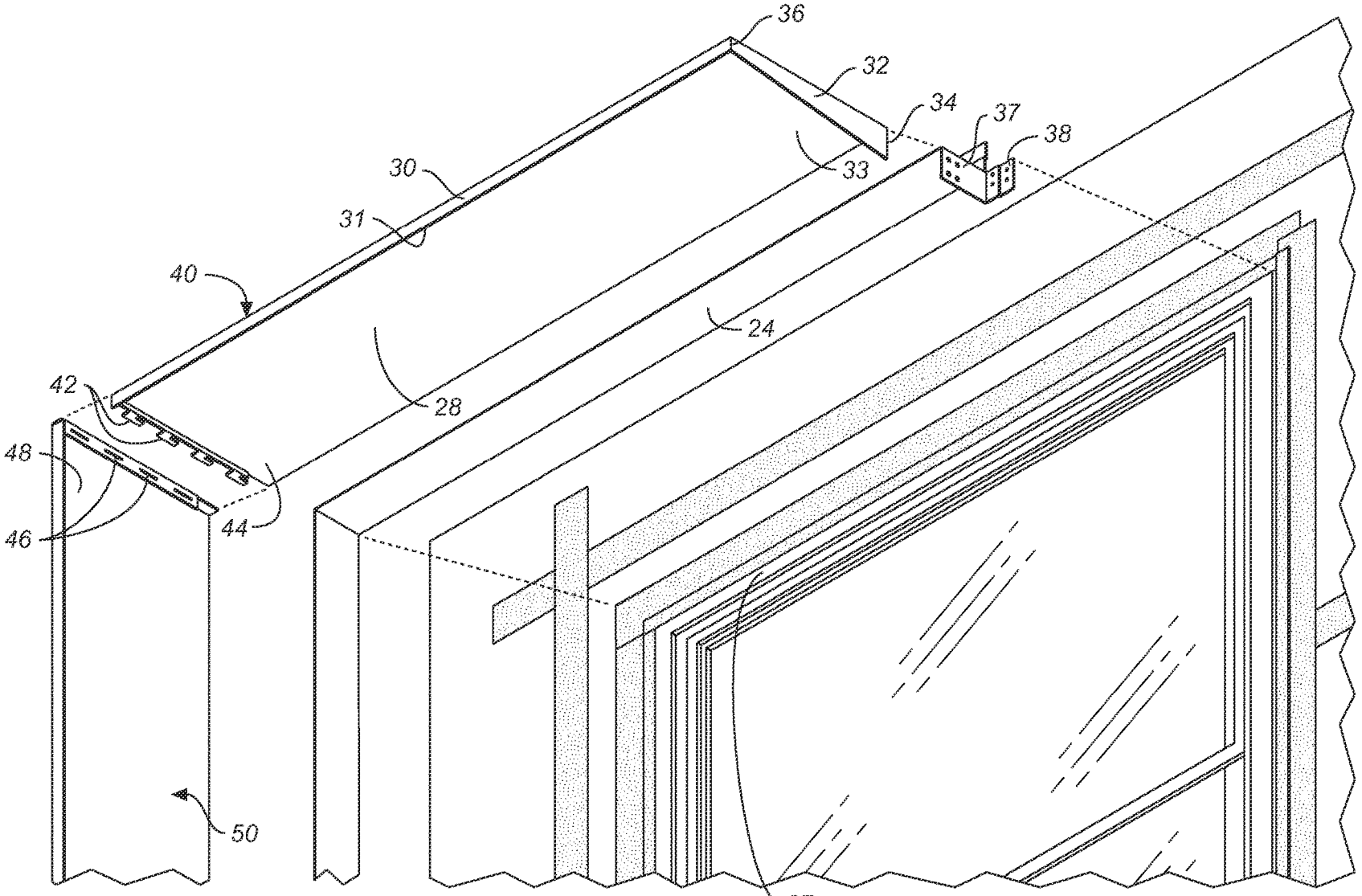
FIG. 6 is an exploded lower right perspective view of the installed sunshade panels shown in FIG. 5.
Figure 7:
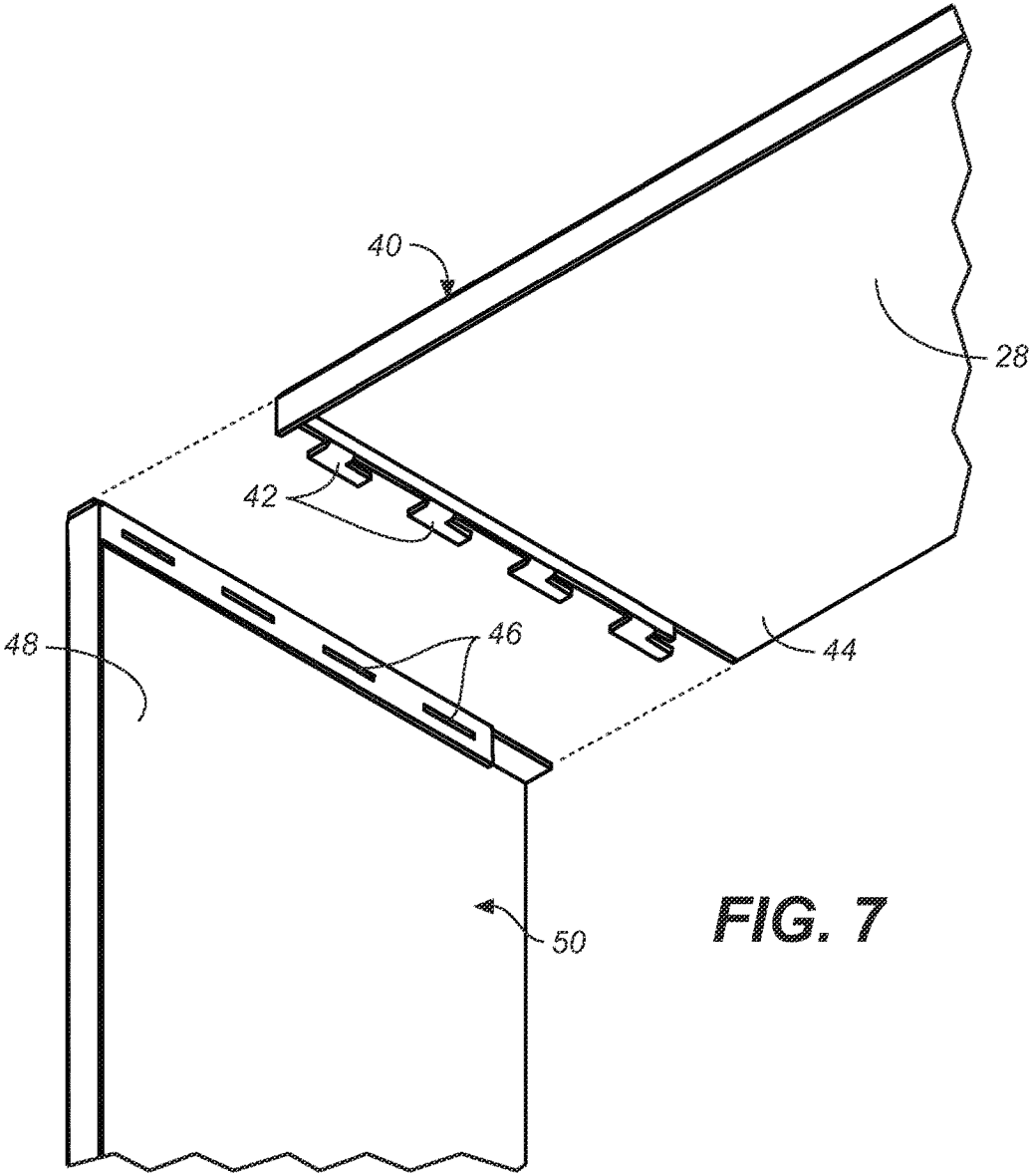
FIG. 7 is an enlarged lower right perspective view of the attachment mechanisms for securing together two sunshade panels.

As seen in FIGS. 6 and 7, when two sunshade panels 20 are attached to cleats 12 on intersecting sides of a window, a first sunshade panel 40 includes an array of hooks 42 on a second end 44 opposite the first end 33 where the end panel 32 is located. An array of slots 46 is provided on one end of the second sunshade panel 50 to receive the hooks 42 extending from the first sunshade panel 40 to lock the first and second sunshade panels together. It will be understood that in the embodiment shown in FIG. 6, the second sunshade panel 50 will be attached to a cleat first following which the hooks 42 of the first sunshade panel 40 will be inserted into the slots 46 on the second sunshade panel 50 upon which the first sunshade panel 40 can be slid towards the face of the building locking the hooks 42 into the slots 46 to secure the first and second sunshade panels together. Installation is completed by affixing the first sunshade panel 40 to a cleat 12. Sunshade panels 20 can be installed on as many sides of a window as are desired.

An advantage of the sunshade attachment system described above is that the cleats 12 can be installed around a window during construction enabling attachment of the sunshade panels 20 late in the construction process to minimize the potential for damaging the sunshades. An additional advantage is that the cleats and sunshade panels of a sunshade system according to the invention are formed by folding a unitary sheet metal blank thereby reducing construction costs.

There have thus been described and illustrated certain embodiments of a sunshade attachment system according to the invention. Although the present invention has been described and illustrated in detail, it should be clearly understood that the disclosure is illustrative only and is not to be taken as limiting, the spirit and scope of the invention being limited only by the terms of the appended claims and their legal equivalents.

We claim:

1. A sunshade attachment system for securing a sunshade around the perimeter of a window, the sunshade attachment system comprising:

at least one cleat having a building attachment flange and a sunshade attachment flange, the building attachment flange for securing to a building face around the perimeter of the window, the sunshade attachment flange extending perpendicularly from the building face, and at least one sunshade panel secured to the sunshade attachment flange of the at least one cleat such that the at least one sunshade panel extends perpendicularly from the building face, the at least one sunshade panel comprising a plurality of slots configured to receive a plurality of hook members for coupling the at least one sunshade panel with an adjacent sunshade panel.

2. The sunshade attachment system of claim 1, wherein the building attachment flange comprises an offset strip adjacent to the sunshade attachment flange for accommodating a nailing flange of the window.

3. The sunshade attachment system of claim 1, wherein the at least one cleat comprises an end support extending perpendicularly from one end of the sunshade attachment flange, wherein the at least one sunshade panel comprises:

a main panel;

a front panel; and an end panel, the main panel having a front edge and a first end, the front panel extending substantially perpendicularly from the front edge of the main panel, the end panel extending perpendicularly from the first end of the main panel and disposed perpendicularly to the front panel, the end panel having a proximal edge secured to the end support of the cleat for supporting an end of the sunshade panel.

4. The sunshade attachment system of claim 3 further comprising:

a nailing tab extending perpendicularly from the end support of the cleat for securing the end support to the building face.

5. The sunshade attachment system of claim 3, wherein the end panel comprises a distal edge shorter than the proximal edge giving the end panel a tapered shape.

6. The sunshade attachment system of claim 1, wherein the at least one cleat is formed from a unitary blank of sheet metal.

7. The sunshade attachment system of claim 1, wherein the at least one sunshade panel is formed from a unitary blank of sheet metal.

8. The sunshade attachment system of claim 1, wherein the at least one sunshade panel comprises a plurality of sunshade panels including a first and a second sunshade panel, a main panel of the first sunshade panel having a first end and an opposing second end, wherein a plurality of hooks extends outwardly from one end of the main panel of the first sunshade panel, wherein a main panel of the second sunshade panel comprises a plurality of slots in one end of the main panel of the second sunshade panel for receiving a plurality of hooks of the first sunshade panel for attaching the first and second sunshade panels together.

9. The sunshade attachment system of claim 1, further comprising a waterproof barrier configured to be positioned over the building attachment flange of the at least one cleat.

10. The sunshade attachment system of claim 9, wherein the waterproof barrier comprises one of flashing or waterproofing tape.

11. A method for attaching a sunshade to a building face around an edge of a window, the method comprising:

securing a building attachment flange of a cleat to the building face, the cleat having a sunshade attachment flange extending perpendicularly from the building attachment flange;

securing a sunshade panel to the sunshade attachment flange so that the sunshade panel extends perpendicularly from the building face; and inserting a plurality of hooks on one end of the sunshade panel into an adjacent sunshade panel for locking the sunshade panel with the adjacent sunshade panel.

12. The method of claim 11, wherein the window comprises a nailing flange attached to a perimeter of a window opening in the building face, the method further comprising:

securing the building attachment flange to the building face over the nailing flange of the window.

13. The method of claim 12, the method further comprising:

securing an offset strip of the building attachment flange to the building face over the nailing flange of the window.

14. The method of claim 11, the method further comprising:

securing a plurality of the cleats to the building face;

inserting the plurality of hooks on one end of a main panel of the sunshade panel into a plurality of slots on one end of a main panel of the adjacent sunshade panel, for locking the sunshade panel and the adjacent sunshade panel together; and securing the sunshade panel and the adjacent sunshade panel to the sunshade attachment flanges of the plurality of cleats so that the sunshade panel and the adjacent sunshade panel are interlocked and extend perpendicularly from the building face.

15. The method of claim 11, further comprising positioning a waterproof barrier over the building attachment flange of the cleat.

16. The method of claim 15, wherein the waterproof barrier comprises one of flashing or waterproofing tape.

17. A sunshade system comprising:

a first cleat coupled to a building structure adjacent a horizontal top of a window, the first cleat comprising a first flange coupled to the building structure and a second flange extending from the first flange and oriented outward from the building structure;

a second cleat fixed adjacent a vertical side of the window, the second cleat comprising a first flange coupled to the building structure and a second flange extending from the first flange outward from the building structure;

a first sunshade mounted to the second flange of the first cleat, the first sunshade extending outward from the building structure along the horizontal top of the window; and a second sunshade mounted to the second flange of the second cleat and extending outward from the building structure along the vertical side of the window, the first and second sunshades collectively forming an L-shaped sunshade structure.

18. The sunshade system of claim 17, wherein the first sunshade is fixed along the horizontal top of the window and the second sunshade is fixed along the vertical side of the window.

19. The sunshade system of claim 17, wherein the first cleat extends from a first end of the horizontal top of the window to a second end of the horizontal top of the window and wherein the second cleat extends from a first end of the vertical side of the window to a second end of the vertical side of the window.

20. The sunshade system of claim 17, wherein the first sunshade and the second sunshade are coupled together.

* * * * *